United States Patent [19]

Schröer et al.

[11] Patent Number: 4,784,727

[45] Date of Patent: Nov. 15, 1988

[54] SIZING AGENT AND USE THEREOF

[75] Inventors: Wolf-Dieter Schröer, Leverkusen; Joachim Probst, Cologne; Ingeborg Kolb, Leverkusen; Ulrich Beck, Bornheim; Peter Mummenhoff, Cologne; Heinz Bäumgen, Leverkusen, all of Fed. Rep. of Germany

[73] Assignee: Bayer Aktiengesellschaft, Leverkusen, Fed. Rep. of Germany

[21] Appl. No.: 459,314

[22] Filed: Jan. 20, 1983

[30] Foreign Application Priority Data

Jan. 30, 1982 [DE] Fed. Rep. of Germany ..... 3203189

[51] Int. Cl.[4] ..... D21H 3/02

[52] U.S. Cl. ..... 162/158; 106/243; 106/287.2; 162/168.2; 162/179

[58] Field of Search ..... 162/158, 179, 168, 168.2; 106/243, 287.2

[56] References Cited

U.S. PATENT DOCUMENTS

| | | | |
|---|---|---|---|
| 2,961,366 | 11/1960 | Weisgerber | 162/158 |
| 3,046,186 | 7/1962 | Arlt | 162/167 |
| 3,666,512 | 5/1972 | Kulick | 106/213 |
| 4,243,481 | 1/1981 | Dumas | 162/158 |

FOREIGN PATENT DOCUMENTS

| | | | |
|---|---|---|---|
| 602107 | 7/1960 | Canada | 162/158 |
| 2951696 | 7/1980 | Fed. Rep. of Germany | 162/158 |
| 1373788 | 11/1974 | United Kingdom | 162/158 |
| 154853 | 3/1978 | United Kingdom | 162/158 |

*Primary Examiner*—Peter Chin

*Attorney, Agent, or Firm*—Connolly & Hutz

[57] ABSTRACT

A sizing agent which contains from 1 to 60 parts, by weight, of a fixing and sizing accelerating agent and from 0 to 80 parts, by weight, of conventional auxiliaries per 10 parts by weight of hydrophobic, cellulose-reactive sizing materials, the fixing and sizing accelerating agent being a polymer composed of linear or branched carbon chains, to which primary, secondary or tertiary amino and/or quaternary ammonium groups are bound directly or by side chains exhibits a thorough and rapid sizing effect, in particular in the better sizing of paper.

5 Claims, No Drawings

SIZING AGENT AND USE THEREOF

This invention relates to a sizing agent, which is based on a hydrophobic, cellulose-reactive sizing material combined with a fixing and sizing accelerating agent, and to the use thereof in the production of sized papers.

The sizing of paper using hydrophobic, cellulose-reactive sizing agents is known. German Pat. No. 1,148,130 describes aqueous emulsions which contain ketene dimers together with amine-modified starch. German Offenlegungsschrift No. 2,951,507 discloses emulsions which consist of a ketene dimer, an anionic dispersing agent and a cationic resin, which is obtained as a reaction product of epichlorohydrin and a polyaminopolyamide or as a condensate of cyanamide or dicyanamide and polyalkylene polyamines, and water. German Offenlegungsschrift No. 2,710,061 states that the combination of the polycondensates mentioned with ketene dimer emulsions improves the sizing action outside the paper-making machine. German Offenlegungsschrift No. 2,710,060 discloses the sizing-accelerating effect of reaction products of the polymer of diallylamine and epichlorohydrin, which, however, may only be combined with ketene dimer emulsion in a considerable dilution. German Offenlegungsschrift No. 2,514,128 describes emulsions which contain a combination of ketene dimers and polyvinyl pyrrolidone or polyvinyl caprolactam, but which also require the simultaneous use of a fixing agent.

In addition to the hydrophobic cellulose-reactive sizing agents based on ketene dimers, hydrophobic cellulose-reactive sizing agents based on anhydrides are also described, for example in U.S. Pat. Nos. 3,582,464 and 3,244,767; and in German Offenlegungsschrift Nos. 2,710,061; 2,947,174 and 2,804,202; also such sizing agents based on isocyanates (for example, in German Offenlegungsschrift No. 2,710,061).

A serious disadvantage of hydrophobic cellulose-reactive sizing agents is that a fixing and a sizing aocelerating agent must also be used in order to achieve a suitable sizing effect. Another disadvantage, in particular of sizing with a ketene dimer emulsion, is that the complete sizing effect is not realised in the drying stage of the paper-making machine, but only occurs very slowly outside this machine.

The additives to hydrophobic cellulose-reactive sizing agents which have been proposed hitherto have been unable sufficiently to overcome these disadvantages.

Thus, an object of the present invention is the production of sizing agents based on hydrophobic cellulose-reactive sizing materials which exhibit an improved and more rapid sizing effect by the use of new fixing agents.

This object is achieved by using as a fixing and sizing accelerating agent a polymer composed of linear or branched carbon chains, to which primary, secondary or tertiary amino and/or quaternary ammonium groups are bound directly or by side chains.

Thus, the present invention provides a sizing agent based on hydrophobic, cellulose-reactive sizing materials, fixing agents and optionally other auxiliaries, characterised in that from 1 to 60 parts, by weight, of a fixing and sizing accelerating agent, and from 0 to 80 parts, by weight of conventional auxiliaries are used per 10 parts, by weight, of hydrophobic, cellulose-reactive sizing materials, the fixing and sizing accelerating agent being a polymer composed of linear or branched carbon chains, to which primary, secondary or tertiary amino and/or quaternary ammonium groups are bound directly or by side chains.

The present invention also provides the use of the above-mentioned sizing agents for sizing paper, in particular for the pulp sizing of paper.

Hydrophobic, cellulose-reactive sizing agents are known. Anhydrides, isocyanates and esters are used, the ketene dimers being particularly useful.

The following are included as hydrophobic radicals which carry the reactive groups: alkyl, alkenyl, cycloalkyl, aryl, aralkyl and alkaryl groups.

Conventional anhydrides include colophonium anhydride (U.S. Pat. No. 3,582,464), anhydrides of the structure:

$$R_1—CO—O—CO—R_2$$

wherein $R_1$ and $R_2$ represent straight- or branched-chain alkyl, aralkyl or alkaryl radicals having more than about 14 carbon atoms, and anhydrides of the structure:

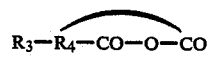

wherein $R_4$ represents a dimethylene or trimethylene radical and $R_3$ represents a radical selected from alkyl, alkenyl, aralkyl or aralkenyl radical having more than 7 carbon atoms, for example substituted cyclic dicarboxylic acid anhydrides, such as succinic acid anhydride and glutaric acid anhydride, (German Offenlegungsschrift No. 2,710,061), and oligomers of maleic acid anhydride and polymerisable olefins, (German Offenlegungsschrift Nos. 2,947,174 and 2,804,202; U.S. Pat. No. 3,244,767).

Conventional isocyanates (German Offenlegungsschrift No. 2,710,061) are, for example, those which contain hydrocarbon radicals having at least 12 carbon atoms, preferably from 14 to 36 carbon atoms, such as colophonium isocyanate, hexadecyl isocyanate, octadecyl isocyanate and 6-phenyldecyl isocyanate (German Offenlegungsschrift No. 2,710,061).

Numbered among the esters are the ketene dimers corresponding to the following general formula:

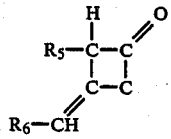

wherein $R_5$ and $R_6$ represent hydrocarbon radicals having from 8 to 30 carbon atoms which may also contain unsaturated and/or cyclic hydrocarbon groups, for example saturated or unsaturated alkyl, aralkyl, alkylaryl or alkylcycloalkyl groups. Commercially valuable ketene dimers are obtained from fatty acids having from 12 to 22, in particular from 14 to 20, carbon atoms. Commercial fatty acid mixtures, such as commercial stearic acid, are particularly suitable which contain as the main component stearic and palmitic acid, and fatty acid mixtures which are derived from naturally occurring fats, for example coconut oil, babassu oil, palm kernel oil, palm oil, olive oil, arachis oil, rapeseed oil, beef tallow, lard and whale blubber. The ketene dimers are produced from the fatty acids via the corresponding fatty acid chlorides, from which ketene dimers may be obtained by reaction with tertiary amines by the release of hydrogen chloride.

The new fixing and sizing accelerating agents are produced by homo-, co- or graft polymerising vinyl compounds containing amino and/or ammonium groups by themselves or combined with other vinyl compounds, or by introducing amino groups into homo-, co- or graft polymers, for example by reacting homo-, co- or graft polymers which contain reactive groups with diamines, one amino group of which is a primary or secondary amino group, or by amino-formylating in a known manner homo-, co- or graft polymers containing amide groups, or by splitting off the protective groups from homo-, co- or graft polymers which contain protected amino groups, or by quaternising in a known manner homo-, co- or graft polymers having tertiary amino groups.

The following are examples of monomers containing amino groups: N,N-dialkyl-aminoalkyl(meth)acrylates and N,N-dialkyl-aminoalkyl(meth)acrylamides, such as N,N-dimethyl-aminoethylacrylate, N,N-dimethyl-aminoethyl methacrylate, N,N-diethyl-aminoethyl acrylate, N,N-diethyl-aminoethyl methacrylate, N,N-dimethyl-aminoethyl acrylamide, N,N-dimethyl-aminoethyl methacrylamide, N,N-diethyl-aminoethylacrylamide, N,N-diethyl-aminoethyl methacrylamide, 2-vinyl pyridine, 4-vinyl pyridine, N-vinyl imidazole and methyl-substituted N-vinyl imidazoles and N,N-disubstituted vinyl benzylamines and β-dialkylaminoethyl styrenes. N,N-dimethyl-aminoethyl acrylate, N,N-dimethyl-aminoethyl methacrylate, N,N-dimethyl-aminoethyl acrylamide and N,N-dimethyl-aminoethyl methacrylamide are preferred. The first two acrylates mentioned are particularly suitable.

Monomers introducing ammonium groups may be obtained by reacting the above-mentioned monomers containing amino groups with conventional quaternising agents. The following are mentioned as examples: trimethylammoniumethyl(meth)acrylate, trimethylammonium-ethyl(meth)acrylamide and N,N-dimethyl-N-(2,3-epoxypropyl)-ammonium-ethyl (methacrylamide), N,N-dimethyl-N-(2,3-epoxypropyl)-ammoniumethyl(meth)acrylate, N,N-dimethyl-N-(3-chloro-2-hydroxypropyl)ethyl ammonium(meth)acrylamide and N,N-dimethyl-N-(3-chloro-2-hydroxypropyl)ethylammonium(meth)acrylate.

Anhydride, ester, amide, nitrile and haloalkyl groups are mentioned as reactive groups which may be partly or completely reacted with diamines in known manner in a secondary reaction. They may be introduced by means of monomers, such as maleic acid anhydride, methyl acrylate, methyl methacrylate, acrylic acid anhydride, chloroethyl vinyl ether and p-chloro-methyl styrene.

Diamines which are suitable for the reactions with the reactive groups include the following, for example: N,N-dimethylaminopropylamine, N,N-dimethylaminoethylamine, N,N-diethylaminopropylamine, N,N-diethylaminoethylamine, N-(aminoethyl)piperazine and N-(aminopropyl)piperazine.

Monomers which contain protected amino groups from which the amino groups are completely or partly released in a known manner only after polymerisation, include vinyl amides, such as N-vinyl formamide, N-methyl-N-vinyl formamide, N-vinyl acetamide and N-methyl-N-vinyl acetamide, vinyl imides, for example N-vinyl succinimide and N-vinyl phthalimide, N-vinyl carbamic acid esters, for example O-t-butyl-N-vinyl carbonate and O-methyl-N-vinyl carbamate.

Monomers which may be co- or graft polymerised with the above-mentioned monomers introducing amino groups are those which result in hydrophobic fragments in co- or graft polymers, for example olefins, such as ethylene, propylene, isobutylene and diisobutylene, dienes, such as butadiene and isoprene, vinyl compounds, such as styrene, p-, m- or o-methyl styrene, α-methyl styrene and p-, m- or α o-chloro styrene, vinyl ethers, vinyl esters, such as vinyl acetate, vinyl chloride, vinylidene chloride, (meth)acrylates, such as methyl methacrylate, ethyl methacrylate, n-butyl methacrylate, methyl acrylate, ethyl acrylate, n-butyl acrylate and 2-ethylhexyl acrylate, acrylonitrile and methacrylonitrile.

Copolymerisation may take place in substance or preferably in solution, and may be carried out discontinuously or continuously, or by the monomer supply process. Continuous and monomer supply processes are particularly preferred.

In the latter type of process, the solvent is introduced, adjusted to the polymerisation temperature and the monomer mixture is added dropwise into the solvent at the same time as the initiator. The mixture is reactivated after some time, and the reaction is completed up to a conversion of from about 99.0 to 99.9%.

The polymerization temperature may range from 50° to 150° C. preferably from 60° to 100° C. Of course, it depends on the type of initiator which is used and on the half-life thereof.

Radical-forming compounds which are conventional for initiating polymerizations are included, for example azo compounds, such as azoisobutyronitrile, or peroxides, such as t-butyl-perpivalate, t-butyl-per-2-ethylhexanoate, benzoyl peroxide, t-butyl perbenzoate, di-t-butyl peroxide and cumene hydroperoxide. They are generally used in quantities of from 0.1 to 6%, by weight, based on the initial monomer mixture. Quantities of from 0.5 to 4%, by weight, are preferred.

Water or water-miscible and non-water-miscible organic solvents are included as a reaction medium for the polymerization in solution. The following are suitable for this purpose: alcohols, such as ethanol and isopropanol, ketones, such as acetone, ethylmethyl ketone and methylisobutyl ketone, esters, such as methylglycol acetate dioxane, N-dimethyl formamide and aromatics, such as benzene, toluene and xylene.

A polymerization in a high solution concentration of from about 50 to 90%, by weight, of the final polymer is recommended to prevent as far as possible the introduction of solvent into the final aqueous solution. After polymerization, the N,N-dialkylamino groups may be quaternised, advantageously in the solvent which has already been used for polymerization.

The following are included as suitable quaternising agents, for example: alkyl and aralkyl halides, such as methyl chloride, methyl bromide, butyl bromide and benzyl chloride, other halogen compounds, such as propargylchloride, allyl chloride and chloroacetic acid ethyl ester, epihalohydrins, such as epichlorohydrin and epibromohydrin, suitable esters, such as dimethyl sulphate and p-toluene sulphonic acid methyl ester, and epoxides, such as ethylene oxide and propylene oxide.

It is also possible to use mixtures of these quaternising agents. Epihalohydrins are preferred, particularly epichlorohydrin.

The quaternising agents are added to the polymer solutions in quantities such that from 0.1 to 2.0 moles of quaternising agent are produced per mole equivalent amino group. Mol ratios of from 1:0.2 to 1:1.2 (amino group:quaternising agent) are preferred. Quaternisation takes place at a temperature of from 25° to 160° C. preferably from 40° to 80° C. The reaction generally lasts from 0.5 to 10 hours.

In order to obtain water-soluble cationic polymers, water-soluble organic or inorganic acids are also added which protonate the non-quaternised free amino groups. The following are included as acids: formic acid, acetic acid, propionic acid, lactic acid, hydrochloric acid, nitric acid, sulphuric acid and phosphoric acid. Formic acid, acetic acid and hydrochloric acid are particularly preferred. The acids are added in quantities of from 50 to 500 mol %, based on the tertiary amino groups bound in the polymer. A quantity of from 100 to 300 mol % of acid is preferred. If epichlorohydrin is used as the quaternising agent, polyadditions and gelling reactions resulting therefrom are simultaneously interrupted by adding the acids.

Water is generally used as solvent for the polycations. After the polymers have been dissolved in the water, from about 10 to 30%, by weight, preferably from 15 to 25% by weight, solutions are present. The organic solvents which are still contained therein should be removed by distillation if they react with the reactive sizing agent, or if they do not form homogeneous mixtures with water. Alcohols and aromatics and longer-chain ketones, in particular, come into this category.

Those homo-, co or graft polymers which are composed of hydrophobic and hydrophilic monomer units are preferred, and the ratio of hydrophobic to hydrophilic monomer units is selected such that water-emulsifiable or water-soluble polymers are obtained.

The following are preferred as fixing and sizing accelerating agents: in particular copolymers of N,N-dialkylamino-alkyl(meth)acrylates and/or amides and/or alkyl(meth)acrylates, styrene, isobutylene, diisobutylene, vinyl acetate and/or acrylonitrile; also reaction products of copolymers of maleic acid anhydride and styrene and/or diisobutylene with a mixture of from 0 to 50 mol % of methylamine, ethylamine, propylamine, butylamine and/or cyclohexylamine and from 100 to 50 mol % (based on the primary amino group) of N,N-dimethyl-aminopropylamine and/or N-(aminoethyl)-piperazine and subsequent quaternisation up to a quaternisation degree of from 0 to 100%, also, the products of partial hydrolysis of copolymers of N-vinyl acetamide, N-methyl-N-vinyl acetamide or O-methyl-N-vinyl carbamate and vinyl acetate.

Fixing and sizing accelerating agents which are particularly preferred include statistical terpolymers which are composed in a chemically uniform manner, i.e. are of as low a heterogeneity as possible, consisting of the following:

(a) from 8 to 20%, by weight, of N,N-dimethyl-aminoethyl acrylate and/or N,N-dimethyl-aminoethyl methacrylate;

(b) from 45 to 80%, by weight, of styrene; and (c) from 8 to 35%, by weight, of acrylonitrile, and the dimethylamino groups of the terpolymer being protonated, and optionally also partly or completely quaternised.

The heterogeneity of the chemical composition may be determined by taking a sample during polymerization and then determining the composition by elementary analysis, by OH number determination etc. It is also possible to characterise the chemical heterogeneity by precipitation fractionation, for example using the solvent/precipitant system of acetone/petroleum ether. The heterogeneity parameters $\sigma_i$ which are calculated by the measured copolymerization parameters and are also found experimentally range from 0 to 0.06, preferably from 0.01 to 0.05. The $\sigma_i$ parameters are defined for each comonomer in the copolymer. $\sigma_i$ is a measurement for the scattering and is defined in the literature (H. G. Elias, Makromol. Chem. 104 (1967), P. 142).

The advantage of such copolymers is a very good water-solubility even with a very low content of basic comonomers and an outstanding emulsifier effect.

In the context of the present invention, the term "auxiliaries" is to be understood as designating the following, for example: emulsifiers, solvents, thickeners, biocides, such as fungicides, and anti-foaming agents.

The emulsions are produced, for example, by dispersing the hydrophobic cellulose-reactive sizing material, to which from about 5 to 35% by weight of a liquid hydrocarbon, such as toluene, cyclohexane and octane, or hydrocarbon mixtures may be added, in water at a temperature of from 30° to 90° C. The following may be used as emulsifiers; for example: anionic dispersing agents selected from cresol-naphthol sulphonic acid-formaldehyde condensates or phenol-bisulphite urea condensates, non-ionic emulsifiers obtained by adding ethylene oxide to hydroxyl groups, and compounds containing relatively long hydrocarbon radicals, such as saturated and unsaturated alcohols having from 12 to 18 carbon atoms, or alkylated phenols, starches and combinations of two or more of the emulsifiers mentioned. A combination of anionic dispersing agents with cationically-modified starch is preferred. The quantities of emulsifiers are calculated such that emulsions are obtained which are stable for a long time and this is within the experience of those skilled in the art. The stability of the aqueous emulsions may be considerably increased by making an adjustment to an acid pH. A pH of from 2.0 to 5.5, preferably from 3.0 to 4.5 is usually adjusted using mineral acid or $C_1$–$C_4$ carboxylic acids.

To produce the new sizing agent, one of the above-described emulsions is intensively mixed with an adequate quantity of the fixing and sizing accelerating agent to increase the sizing effect of the sizing material. It has been found that from 0.1 to 6 parts, by weight, per part, by weight, of the hydrophobic cellulose-reactive sizing material in the emulsion leads to good results. A quantity of from 0.25 to 4 parts, by weight, is preferred.

It may be advantageous directly to disperse the sizing material in an aqueous dispersion or solution of the polymer and to dispense with the addition of emulsifiers.

In order to increase the storage stability, the emulsion may contain thickeners, for example starch derivatives, cellulose derivatives, polycarboxylic acids, and polysulphonic acids.

The sizing agents according to the present invention contain generally from 2 to 10%, by weight, of hydrophobic reactive sizing material (based on the total sizing agent).

Compared to the prior art (polycondensates), it has surprisingly been found that the sizing effect of the hydrophobic cellulose-reactive sizing material, in particular of ketene dimers, may be considerably increased even by such an added quantity of water-soluble cationic copolymer which, taken on its own, does not exhibit a significant sizing effect when used in paper pulp. It was also unforseeable that an almost complete realisation of sizing effect may be achieved by the water-soluble cationic polymer which is added even at drying temperatures of 90° C. With respect to comparative products according to German Offenlegungsschrift No. 2,951,507, the realisation of the sizing effect is clearly improved.

EXAMPLE 1

Production of the cationic fixing and sizing accelerating agents (A–F)

50 g of isopropanol are introduced into a 2 liter flask equipped with a stirrer, a reflux condenser and a gas inlet and outlet. The flask is then thoroughly flushed with nitrogen and heated to 80° C. The mixtures I and the solutions II of Table I are metered in at this temperature over a period of 2 hours with the exclusion of air. The mixture is then stirred for 2 hours and re-activated with III. Thereupon, it is stirred for 12 hours at 80° C.

After polymerization, the mixture is cooled to the temperatures specified in Table I and the quantities of quaternising agents (IV) specified in the Table are metered in. The mixture is then stirred for 3 hours and subsequently mixed with the quantities of acetic acid which are also stated in Table I. At the same time, enough deionised water is added to the mixture for an approximately 20%, by weight, solution to be produced. The solution is then stirred until a homogeneous aqueous solution results. From 100 to 150 g of organic solvent and water are distilled off under a water jet vacuum. The residual contents of acetone and isopropanol are then clearly below 0.5% by weight. The quantity distilled off is then replaced by deionised water.

The aqueous solutions have the properties which are also indicated in Table I.

Production of the fixing and sizing accelerating agents G and H (G) 123 g of copolymer of the same molar proportions of isobutylene and maleic acid anhydride are heated to 90° C. for 1 hour in an autoclave with 1 g of polyvinyl alcohol and 90 g of 3-dimethylaminopropylamine under nitrogen and then heated at 100° C. for 3 hours. After cooling, the solids are centrifuged off, washed and dried. To produce the emulsion, a 10% by weight aqueous solution of the polymer at pH 3 (hydrochloric acid) is prepared.

(H) 60° g of copolymer of 30 mol % of O-methyl-N-vinyl carbamate and 70 mol % of vinyl acetate were heated at 80° C. for 15 hours in 300 g of 5% aqueous hydrochloric acid. The cooled solution had a solids content of 12.5% and the polymer had a intrinsic viscosity number $\eta = 1.70$ dl/g (0.9% NaCl solution).

TABLE I

| Accelerating agents | | A | B | C | D | E | F |
|---|---|---|---|---|---|---|---|
| Polymerisation temperature [°C.] | | 80 | 80 | 80 | 80 | 80 | 80 |
| Quaternisation temperature [°C.] | | 40 | 40 | 50 | 40 | 40 | 40 |
| I. | N,N—dimethyl-aminoethyl-methacrylate [g] | 27.3 | 33.8 | 28 | 28 | 28 | 28 |
| | Styrene [g] | 78.4 | 87.1 | 89 | 89 | 89 | 89 |
| | Methyl methacrylate [g] | — | 48.4 | — | — | — | — |
| | Acrylonitrile [g] | — | — | 23 | 23 | 23 | 23 |
| | n-butyl acrylate [g] | 29.7 | — | — | — | — | — |
| II. | Azoisobutyronitrile [g] | 4 | 4.4 | 5 | 5 | 5 | 5 |
| | Acetone [g] | 20 | 22 | 26 | 22 | 22 | 22 |
| III. | Azoisobutyronitrile [g] | 1 | 1 | 0.6 | 0.5 | 0.5 | 0.5 |
| | Acetone [g] | 5 | 5 | 2.6 | 3 | 3 | 3 |
| IV. | Chloroacetic acid ethyl ester [g] | — | — | 16.4 | — | — | — |
| | Epichlorohydrin [g] | 16.1 | 19.9 | — | — | 5.5 | 11 |
| V. | Acetic acid [g] | 20 | 25 | 20 | 20 | 20 | 20 |
| | Concentration [%, by weight] | 19.6 | 23.1 | 20.7 | 19.0 | 20.0 | 22.2 |
| | Viscosity (at 20° C.) [mPa.s] | 235 | 155 | — | 50 | 50 | 50 |
| | pH | 3.9 | 3.9 | 3.0 | 4.0 | 4.0 | 4.2 |

EXAMPLE 2

Production of ketene dimer emulsions (embodiment A)

A mixture of 300 g of cationic potato starch, 25 g of acetic acid and 4675 g of water was stirred for 1 hour at from 90° to 95° C. The mixture was cooled to 60° C. 600 g of ketene dimer, produced from a mixture of palmitic acid and stearic acid and 25 g of anionic dispersing agent (A) phenol-bisulphite-urea condensate or (B) cresol-naphthol sulphonic acid-formaldehyde condensate were stirred in using a high-speed stirrer, and the mixture was passed twice through a Knollenberg homogeniser under a pressure of 200 bars. The homgenised product was diluted with water to a ketene dimer content of 7.7% by weight, and cooled to 30° C. The solution of the fixing and sizing accelerating agent was added at this temperature, and diluted with water to a ketene dimer content of 6% by weight.

TABLE II

| Emulsion | Polymerisation from Example 1 | solids content | Dispersing agent | solids content |
|---|---|---|---|---|
| 2a | A | 4% | A | 0.2% |
| b | B | 4% | A | 0.2% |
| c | C | 4% | A | 0.2% |
| d | D | 4% | A | 0.2% |
| e | E | 4% | A | 0.2% |
| f | F | 4% | A | 0.2% |
| g | F | 1.8% | A | 0.2% |
| h | F | 0.9% | A | 0.2% |
| i | F | 0.5% | A | 0.2% |
| j | — | 0% | A | 0.2% |
| k | F | 4% | A | 0.2% |
| l | G | 2% | A | 0.2% |
| m | H | 2% | A | 0.2% |

EXAMPLE 3

Ketene dimer emulsion (embodiment B)

A 6%, by weight, aqueous solution of cationic starch was produced as described in Example 2. In each case, a parts of the starch solution, b parts of dispersing agent A, c parts of acetic acid, d parts of the polymer solution F and e parts of water were mixed. f parts of a molten ketene dimer, produced from a mixture of palmitic acid and stearic acid, are stirred into this mixture at a temperature of from 60° to 65° C. using a high-speed stirrer and the mixture is passed twice through a Knollenberg homogeniser under a pressure of 200 bars. The homogenised sample was diluted with water to a ketene dimer content of 6% by weight and cooled to 30° C.

TABLE 3

| Emulsion | a | b | c | d | e | f |
|---|---|---|---|---|---|---|
| 3a | — | 10 | — | 400 | 400 | 60 |
| b | 300 | 7 | 5 | 60 | 100 | 60 |
| c | 400 | 7 | 5 | 60 | — | 60 |
| d | 300 | 7 | 5 | — | 100 | 60 |
| e | 400 | — | 5 | 60 | — | 60 |
| f | 400 | — | 5 | 200 | — | 60 |
| g | — | —(+) | 5 | 900 | — | 60 |
| h | — | —(+) | 5 | 250 | — | 60 |

(+)20 parts of emulsifier (from 1 mol nonylphenol and 10 mols of ethylene oxide).

EXAMPLE 4

Sheets of paper are produced on a laboratory sheet forming machine, using the sizing agent emulsions of Examples 2 and 3. A pulp having a solids content of 0.5% was produced in water with a hardness of about 20° dH from 100 of wood pulp (50% birch sulphate, 50% pine sulphate) having a degree of grinding of 30° SR, and 25 parts of chalk. 1.4%, based on the dry weight of the pulp, of emulsion was added. The resulting sheets were wet pressed to a solids content of from 30 to 35%, and then dried for 4 minutes at from 90° to 93° C. on a steam heated drum dryer.

The sheets of paper had a weight per unit area of 80 g/m$^2$. A fixing agent was not used.

The Cobb$_{60}$ value (DIN 53 132) was determined in order to establish the sizing effect. Some papers were also re-heated for 5 minutes at 120° C., or stored for 7 days at 22° C.

TABLE 4

| Example | Emulsion according to Example | Cobb$_{60}$ |
|---|---|---|
| 4a | 2a | 28 |
| b | 2b | 31 |
| c | 2c | 29 |
| d | 2d | 30 |
| e | 2e | 24 |
| f | 2f | 22 |
| g | 2g | 23 |
| h | 2h | 26 |
| i | 2i | 29 |
| k | 2j | 38 |
| l | 3a | 30 |

TABLE 4-continued

| Example | Emulsion according to Example | Cobb$_{60}$ |
|---|---|---|
| m | 3b | 21 |
| n | 3c | 22 |
| o | 3d | 75 |
| p | 3e | 26 |
| q | 3f | 28 |
| r | 3g | 30 |
| s | 3h | 31 |
| t | 2f | 20 (reheated for 5 mins at 120° C.) |
| u | 2f | 22 (stored for 7 days at 20° C.) |
| v | 2l | 25 |
| w | 2m | 23 |

It is claimed:

1. A sizing agent comprising:

(A) hydrophobic, cellulose-reactive sizing materials, (B) from 1 to 60 parts, by weight, of fixing and sizing acceleration agents, per 10 parts, by weight, of the hydrophobic cellulose-reactive sizing materials, where the fixing and sizing acceleration agents are statistical terpolymers of:

(a) from 8 to 20% by weight, of N, N-dimethylamino ethyl acrylate, N, N-dimethyl-aminoethyl methacrylate or both;

(b) from 45 to 80%, by weight, of styrene; and (c) from 8 to 35%, by weight, of acrylonitrile, wherein the total of (a) to (c) amounts to 100%, by weight, and the dimethylamino moieties of the terpolymer are protonated.

2. A sizing agent according to claim 1, wherein the dimethyl amino groups of the terpolymer are completely or partly quaternized.

3. A sizing agent according to claim 1 wherein the hydrophohic, cellulose-reactive sizing materials are ketone dimers of the formula:

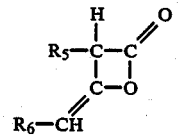

wherein $R_5$ and $R_6$ represent hydrocarbon moieties having from 8 to 30 carbon atoms.

4. A sizing agent according to claim 1, wherein the sizing agent is an aqueous emulsion containing from 2 to 10%, by weight, based on the total sizing agent, of hydrophobic, cellulose-reactive sizing materials.

5. A sizing agent according to claim 1, which further comprises up to 80 pars, by weight, of auxiliaries per 10 parts, by weight, of hydrophobic, cellulose-reactive sizing materials.

* * * * *